US007637749B2

(12) United States Patent
Lang et al.

(10) Patent No.: US 7,637,749 B2
(45) Date of Patent: Dec. 29, 2009

(54) DEVICE FOR ELECTRICAL CONTACTING

(75) Inventors: Felix Lang, Schliengen (DE); Rolf Meier, Ettenheim (DE)

(73) Assignee: Sick AG, Waldkirch (DE)

( * ) Notice: Subject to any disclaimer, the term of this patent is extended or adjusted under 35 U.S.C. 154(b) by 0 days.

(21) Appl. No.: 11/902,420

(22) Filed: Sep. 21, 2007

(65) Prior Publication Data

US 2008/0102657 A1 May 1, 2008

(30) Foreign Application Priority Data

Oct. 25, 2006 (EP) ..... 06022286

(51) Int. Cl.
*H01R 12/00* (2006.01)

(52) U.S. Cl. ..... 439/65; 439/74

(58) Field of Classification Search ..... 439/65, 439/74, 76.1, 79

See application file for complete search history.

(56) References Cited

U.S. PATENT DOCUMENTS 3,715,706 A * 2/1973 Michel et al. ..... 439/493
4,703,394 A 10/1987 Petit et al.
5,156,552 A 10/1992 Zaderej et al.
5,420,440 A * 5/1995 Ketler et al. ..... 250/573
5,567,167 A * 10/1996 Hayashi ..... 439/75
6,109,977 A * 8/2000 Baxter et al. ..... 439/693
6,253,451 B1 * 7/2001 Semmeling et al. ..... 29/842
7,077,658 B1 * 7/2006 Ashman et al. ..... 439/65
7,287,986 B2 * 10/2007 Ho ..... 439/65

FOREIGN PATENT DOCUMENTS

DE 44 30 778 A1 3/1996
EP 0 494 759 A1 7/1992
GB 2 208 566 A 4/1989

* cited by examiner

*Primary Examiner*—Thanh-Tam T Le
(74) *Attorney, Agent, or Firm*—The Nath Law Group; Jerald L. Meyer; Derek Richmond

(57) ABSTRACT

The invention relates to a device for electrically contacting, particularly for contacting circuit boards that are positioned in basically perpendicular fashion relative to each other, with an insulating housing (10) in the form of a tube in whose wall (11) is positioned at least one electrically conductive element (20, 30, 40, 50) exhibiting at least two connector elements (21, 22, 31, 32, 41, 42, 51, 52, 53), such that the connector elements (21, 22, 31, 32, 41, 42, 51, 52, 53) project from the wall (11) of the housing (10).

19 Claims, 5 Drawing Sheets

DEVICE FOR ELECTRICAL CONTACTING

Figure 1:
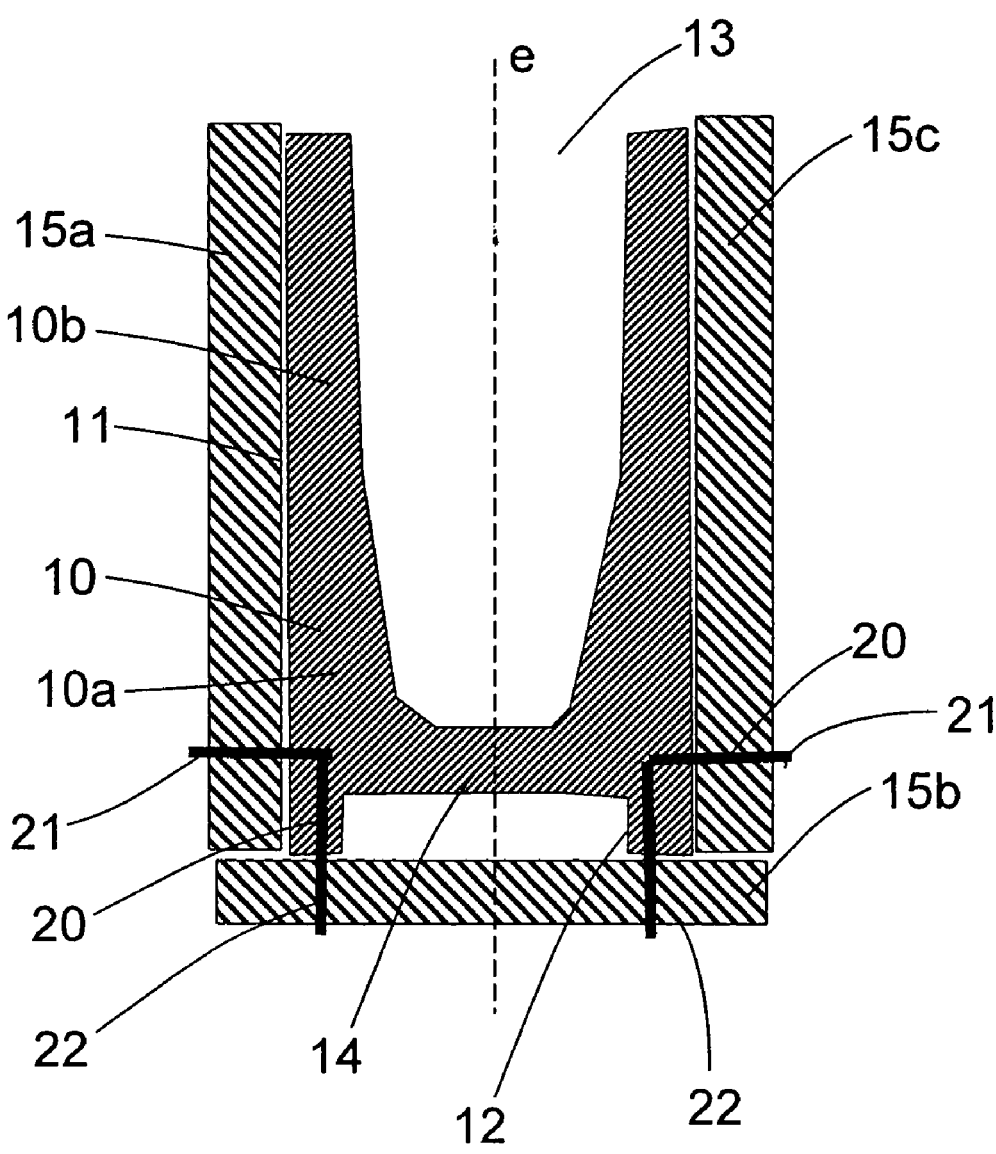

The device relates to a device for electrically contacting, particularly for contacting guide plates that are positioned in basically perpendicular fashion relative to each other.

To allow the positioning of circuit boards in a small space, these circuit boards are often positioned at an angle to each other, particularly a roughly perpendicular angle. To electrically connect these circuit boards it is known to connect adjacent circuit boards using a film hinge by means of which they can be swiveled toward each other. A disadvantage in this method rests in the fact that the film hinge may exhibit symptoms of fatigue caused by alternating loads and particularly in the fact that the circuit boards cannot be positioned relative to each other in abutting fashion, with the result that they cannot be positioned in an optimal spacing-saving manner.

Also known are tubes for optical transmitting and/or receiving elements that are positioned in the initial terminal area of the tube. Starting from the second terminal area, which is turned away from the optical transmitting and/or receiving elements and where an optical element, e.g., a lens, is positioned, light enters the tube, and scattered light is absorbed in the intermediate space between the optical element and the transmitting and/or receiving element. To achieve this end, the inner area of the tube is often provided with a black, light-absorbing surface. DE 44 30 778 C2 refers to a tube in which longitudinal ribs are formed on the tube surface in the intermediate area between the lens and the transmitting and/or receiving element. Incoming optical radiation of a disruptive nature is absorbed by these ribs and is reflected multiply. Tubes of this kind are used, e.g., in light scanners or light barriers, where they are housed jointly with a circuit board on which the appropriate electronic components are positioned.

The goal of the invention is to make possible an arrangement of one or a plurality of tubes on a circuit board in as compact a fashion as possible. The further goal of the invention is to provide a device for electrical contacting, by means of which circuit boards can be electrically connected in a conductive, abutting, and compact fashion.

This goal is solved by a device for electrically contacting which exhibits the features of patent claim 1.

Advantageous embodiments and elaborations of the invention are indicated in the secondary claims.

The electrical contacting device according to the invention exhibits an insulating housing that is designed as a tube, in the wall of which at least one electrically conductive element with at least two connector terminals is positioned, such that the connector elements project from the wall of the housing. A stable connection is provided in that the conductive element, together with the two connector terminals, are positioned in a solid housing, one which is not subject to a bending load. Furthermore, a plurality of circuit boards can be positioned in basically perpendicular fashion, e.g., one of the circuit boards can be positioned on one of the face areas and another circuit board along the wall of the housing. The housing stabilizes the circuit boards relative to each other, and the latter can be positioned in abutting fashion. This permits a particularly compact arrangement of the circuit boards. In the process, however, the design of the housing as a tube further insures that, e.g., four circuit boards can be positioned at right angles along the outer wall of the housing, while the fifth circuit board is positioned in front of one of the tube's face areas. Designing the housing as a tube makes possible a particularly compact arrangement, since the tube serves both to stabilize the circuit boards among themselves and to house the optical components. Moreover, additional components are rendered superfluous, thereby lowering the manufacturing costs.

The electrically conductive element(s) are preferably coated with an insulating plastic to form the housing. Creating the housing from plastic in an injection-molding process takes advantage of a particularly simple manufacturing process, which is also particularly cost-effective. In particular, it is assured that the electrically conductive element is completely covered with plastic (excepting the connector elements) and consequently is well insulated.

In a particularly advantageous elaboration of the invention, one of the two (or more) connector elements projects from one face area of the housing and the other projects from the jacket side of the housing. In this way, it is possible to connect one circuit board, which is positioned in front of the face area of the housing, and another circuit board, which is positioned on the outside of the wall, i.e., on the jacket side of the housing.

The connector elements are preferably designed in the form of plug contacts, force-fitting contacts, soldered pins, or elastic elements. A particularly simple contacting method is thereby permitted, in contrast to, e.g., a snap connection. In particular, the plug contacts, force-fitting contacts, or the elastic elements have an advantage in that no additional step is required in the attachment process once the connector elements have been inserted into, or applied to, the corresponding circuit boards.

Ideally the electrically conductive element will consist of at least one stamping, preferably an elastic stamping. In this way, the one or more electrically conductive elements can be manufactured in a particularly simple and cost-effective manner.

Particularly preferred are fastening elements formed onto the electrically conductive element for the purpose of securing an optical element belonging to the tube, particularly a lens. This renders unnecessary any additional fastenings for the optical element on the tube, since these fastenings can be formed directly on the electrically conductive element.

It is particularly preferred if the fastenings are designed as elastic elements which permit a play-free attachment and positioning of the lens.

In a particularly preferred elaboration of the invention at least one aperture is formed in the electrically conductive element, such that the aperture is positioned in one of the face areas of the housing, and by special preference between a lens and an optical detector, e.g., a photodiode. This makes it possible for the device for electrical contacting to simultaneously serve as an aperture, thus utilizing the fact that an aperture made of an electrically conductive material, e.g. a metal, can have a more sharp-edged design than one made of plastic, with the result that the aperture can be manufactured with greater precision. Integrating an aperture into the device for electrical contacting results in additional space being saved, and several components can be eliminated, thus reducing the number of necessary components.

To improve the optical properties of the device for electrical contacting, the inner diameter of the housing shaped as a tube diminishes in the direction of the aperture, thereby preventing the incident light ray from being reflected.

In a particularly preferred embodiment of the invention the electrically conductive element is designed as a lattice or holohedral area, at least in sections. This makes it possible to apply, at different points on the jacket area of the housing, connector elements which are all electrically connected by the conductive element. If the conductive element is advantageously positioned in circular fashion, at least in a central section of the housing wall, then connector elements intended specifically for contacting the circuit boards can be positioned at various points that are also diametrically opposite each other on the jacket surface of the housing, and all these connector elements will thus have the same potential. In particular, the conductive element—particularly when it is designed as a lattice—can be advantageously designed as an electromagnetic shield, with the result that the device for electrical contacting will simultaneously fulfill a further function as an electromagnetic shield, and additional electromagnetic screens can be omitted.

The device according to the invention can be used particularly for the electrical contacting of light barriers and/or light curtains. Here the device for electrical contacting will simultaneously take the form of a tube with a transmitting and/or receiving element, such that an optical element, particularly a lens, is positioned in the face area of the housing that is turned away from the transmitter and/or receiver, while an aperture is positioned in the side of the device that faces the transmitter and/or receiver.

Figure 2:
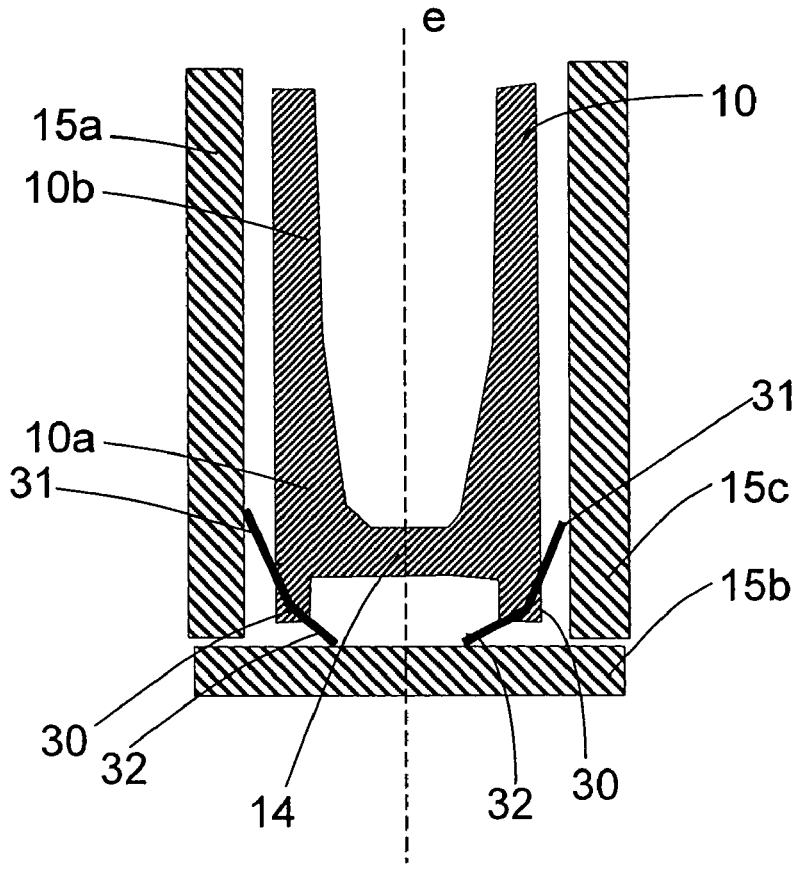
Figure 3:
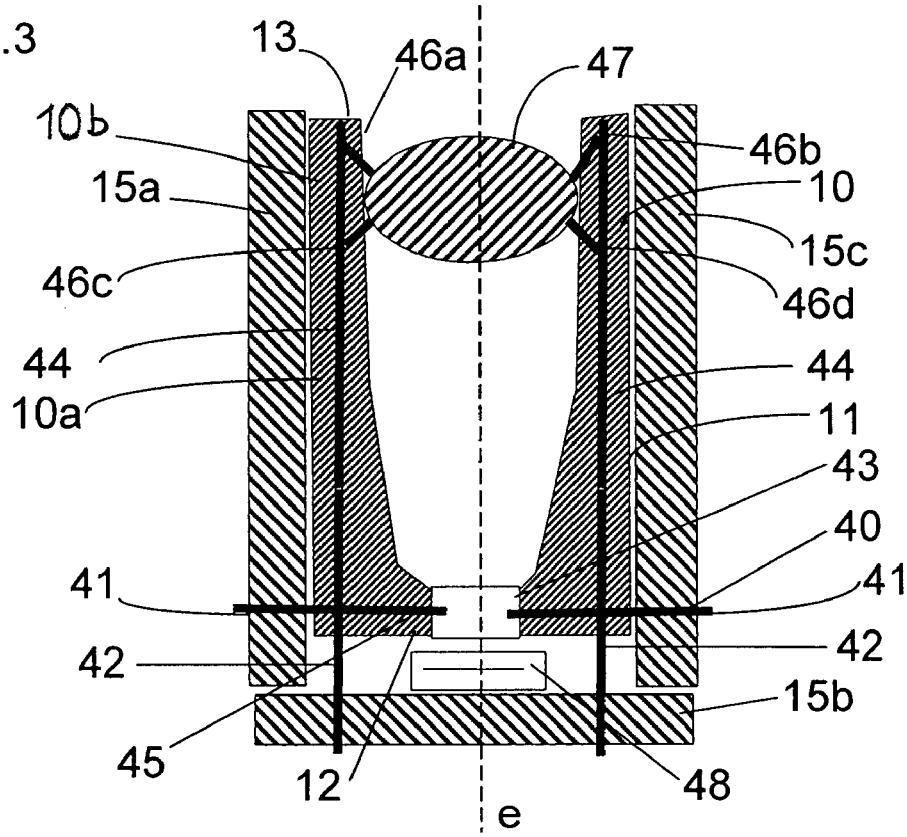
Figure 3:
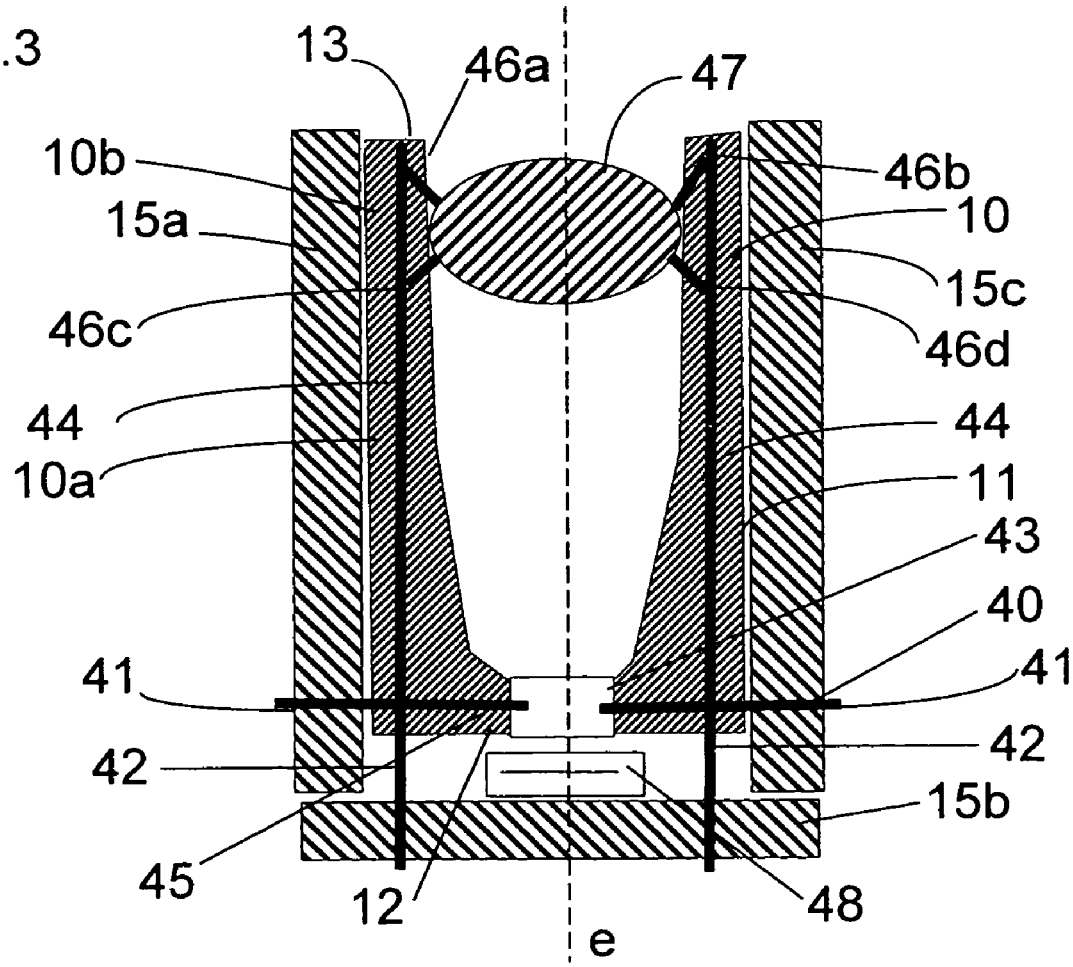
Figure 4:
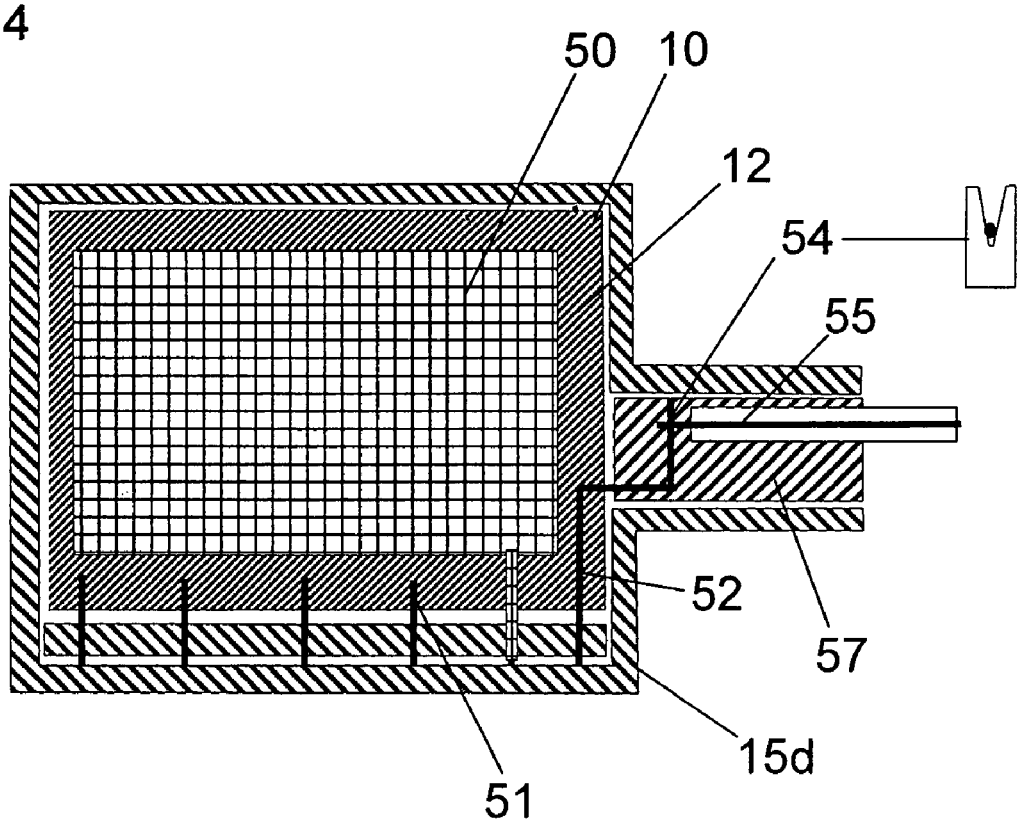
Figure 5:
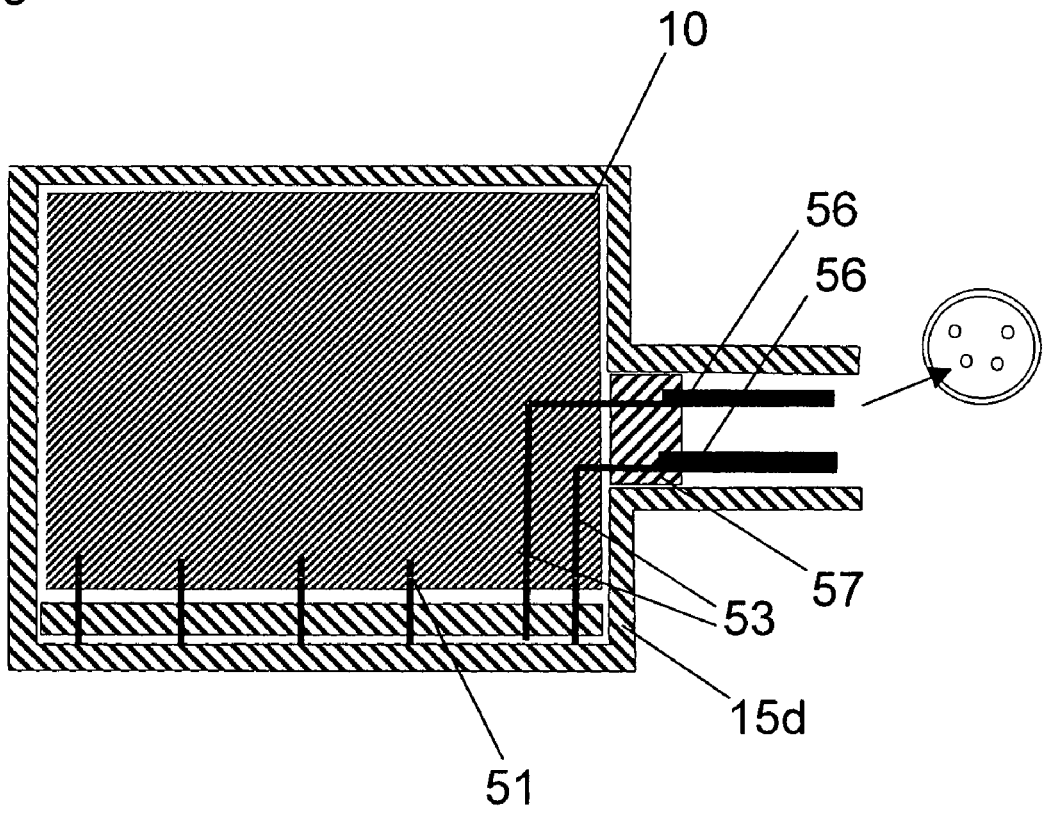
Figure 6:
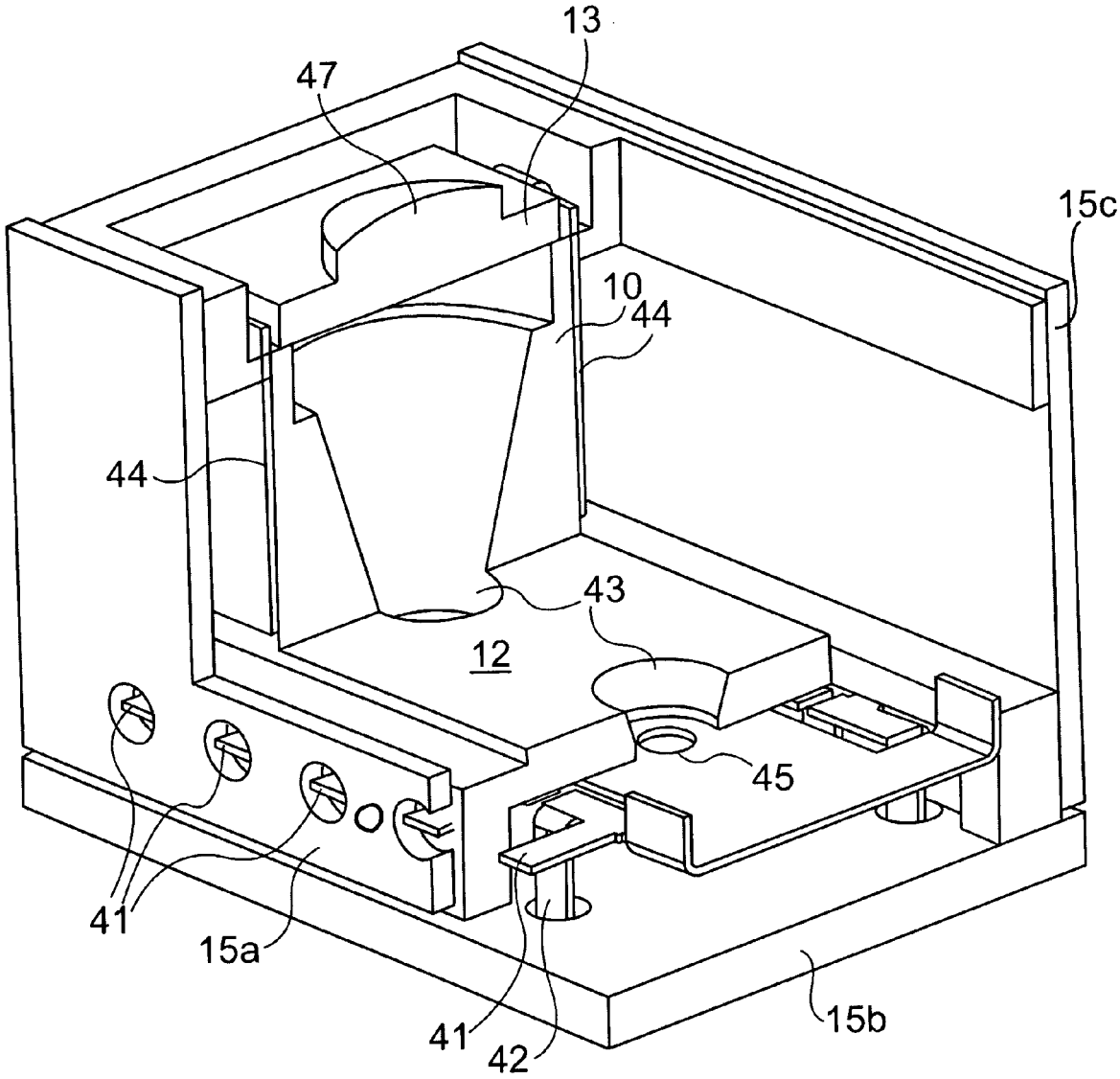

The invention is next described in detail on the basis of the following figures. Shown are:

FIG. 1 a longitudinal section through an initial exemplary embodiment of the invention FIG. 2 a longitudinal section through a second exemplary embodiment of the invention FIG. 3 a longitudinal section through a third exemplary embodiment of the invention FIG. 4 a longitudinal section along a lateral wall of a fourth exemplary embodiment of the invention FIG. 5 a longitudinal section along a lateral wall of a fifth exemplary embodiment of the invention FIG. 6 a perspective view of a sixth exemplary embodiment of the invention.

FIG. 1 shows a housing 10, which is designed as a tube and which exhibits a wall 11, a longitudinal axis e, a face area 12, and another face area 13 opposite the face area 12. The outside of the wall 11 is referred to as the jacket area of the housing. The face area 13 is open, while the face area 12 is closed by a lid 14 that is slightly offset in the inward direction. Along its longitudinal axis e the housing 10 can be roughly divided in the middle into two sections 10*a* and 10*b*, such that section 10*a* is bordered by the face area 12 and section 10*b* is bordered by the open face area 13. In section 10*a* the inner diameter of the housing 10 diminishes slightly in the direction of face area 12.

Three circuit boards 15*a*, 15*b*, 15*c* are positioned on the housing 10. Circuit board 15*b* is positioned in front of face area 12 of housing 10, while both circuit boards 15*a*, 15*c* rest against the wall 11 of the housing 10 and abut circuit board 15*b*. The circuit boards 15*a*, 15*b*, 15*c* are thus positioned in a way that takes up as little space as possible. In particular, circuit boards 15*a*, 15*c* are positioned parallel to each other and perpendicular to circuit board 15*b*.

In order to electrically contact the circuit boards 15*a*, 15*b*, 15*c* among themselves, the housing 10 exhibits two initial conductive elements 20, which are positioned inside the wall 11 of the housing 10. The initial conductive elements 20 are ideally made of metal, for example, wire. The initial conductive elements 20 have an L-shape, such that the unattached ends of the two legs of the L form a first connector element 21 and a second connector element 22.

The two initial conductive elements 20 are positioned in the wall 11 of the housing 10 in diametrically opposite fashion, and the second two connector elements 22 run parallel to the longitudinal axis e, while the first two connector elements 21 run perpendicular to the longitudinal axis e, ideally along a diameter of the housing 10. The first connector elements 21 and the second connector elements 22 project forward from the housing 10, so that a connection can be made between circuit boards 15*a*, 15*b*, 15*c*. In the process, the second connector elements 22 of the two initial conductive elements 20 (those connector elements 22 which project from the wall 11 of the housing 10 on the face area 12) are set on the circuit board 15*b* positioned in front of face area 12, while the first connector elements 21 of the initial conductive elements 20 (those connector elements 21 which project from the jacket area of housing 10) each provides a contact with one of the two circuit boards 15*a*, 15*c*.

The first and second connector elements 21, 22 may take the form of plug contacts, force-fitting contacts, or soldered pins. When the connector elements 21, 22 take the form of plug contacts or force-fitting contacts it is sufficient to insert the connector elements 21 and 22 into the corresponding hole in the circuit boards 15*a*, 15*b*, 15*c*, so that a form-fitting contact is created. If connector elements 21, 22 are soldered pins, said connector elements 21, 22 are soldered into the corresponding boreholes in the circuit boards 15*a*, 15*b*, 15*c*.

The housing 10 will preferably be produced in an injection-molding process, such that the electrically conductive elements 20 are coated with plastic, ideally an insulating plastic. As a result the conductive elements 20 lie in the wall 11 of the housing 10 and are insulated from the surrounding environment.

The conductive elements 20 can be produced as a punching, particularly a flexible punching, in a particularly cost-effective manner.

FIG. 2 shows a longitudinal section through a second exemplary embodiment of the invention. Here identical components have the same reference numerals as in FIG. 1. The exemplary embodiment shown in FIG. 2 principally differs from that of FIG. 1 in the design of the conductive elements. To connect circuit boards 15*a*, 15*b*, 15*c* the exemplary embodiment in FIG. 2 exhibits a second pair of conductive elements 30 in the wall 11 of the housing 10. These second conductive elements 30 are not angled at a 90° angle like the initial L-shaped conductive elements 20, but rather are angled at an obtuse angle, e.g., one of about 150°, and the unattached ends of the legs each form an initial connector element 31 and a second connector element 32. The two connector elements 31, 32 again project from the wall 11 of the housing 10, such that the second two connector elements 32 project from the face area 12 and the first two connector elements 31 project from the jacket area of the wall 11 of the housing 10, and such that the two conductive elements 30 are positioned in diametrically opposite fashion in the wall 11 of the housing 10.

The second two conductive elements 30 are produced from a flexible, electrically conductive material, ideally metal, particularly in the form of a flexible punching, so that the first and second connector elements 31, 32 are elastic elements. Thus the electrical contact between the circuit boards 15*a*, 15*b*, 15*c* is not formed by plugging the connector elements 31, 32 into the corresponding conductive contact areas of the circuit boards 15*a*, 15*b*, 15*c*. One of the two conductive elements 30 connects the first laterally positioned circuit board 15*a* with the circuit board 15*b* positioned in front of the face area 12 of the housing 10, such that the first connector element 31 rests against the circuit board 15*a* and the second connector element 32 rests against the circuit board 15*b*. At the same time, the second of the two conductive elements 30 connects the second laterally positioned circuit board 15*c* with the circuit board 15*b* positioned in front of the face area 12 of the housing 10, such that the first connector element 31 rests against the circuit board 15*c* and the second connector element 32 rests against the circuit board 15*b*.

FIG. 3 shows a longitudinal section through another exemplary embodiment of the invention, and here again identical components are designated with the same reference numerals. In the exemplary embodiment shown in FIG. 3 a third electrically conductive element 40 is assigned to the wall 11 of the housing 10. This conductive element 40 exhibits two initial connector elements 41 and two second connector elements 42. The first two connector elements 41 run perpendicular to the longitudinal axis e of the housing 10, ideally along one diameter of the housing 10, while the second two connector elements 42 run parallel to the longitudinal axis e of the housing 10. The first connector elements 41 project laterally from the jacket area of the wall 11 of the housing 10, while both of the second connector elements 42 project from the face area 12 of the housing. The connector elements 41, 42 here are positioned on the base body 44 of the third conductive element 40, which base body 44 is basically cylindrical in shape and runs inside the wall 11.

In the face area 12 of the housing 10, which in this exemplary embodiment takes the form of a sealing lid and is not recessed slightly, as in the embodiment of FIGS. 1 and 2, there is an axially positioned hole 43. Circumferentially positioned in this hole 43 is an aperture 45, which is positioned at the third conductive element 40. The aperture 45 thus lies on a cross-section through the basically cylindrical base body 44 of the third conductive element 40. The aperture 45 is made of the same material as the third conductive element 40, e.g., metal and can thus be shaped more precisely and with sharper edges than would be the case if it were made of a plastic in an injection-molding process.

Outside of the housing 10 and below the aperture 34 there is an optical detector, ideally a photodiode 48, onto which incident light rays can be focused using a lens 47. The lens 47 is positioned in the vicinity of the face area 13 lying opposite the face area 12 of the housing 10 and is held in place by fasteners 46*a*, 46*b*, 46*c*, 46*d*, which are positioned on the base body 44 of the third conductive element 40 and which project from the wall 11 on the inside of the housing 10. The fasteners 46*a*, 46*b*, 46*c*, 46*d* will ideally take the form of elastic elements, in which the lens can be secured without play and can be positioned. The housing 10, whose diameter diminishes in section 10*a*, moving in the direction of the face area 12 and the aperture 45, thus also serves as a tube for an optical configuration, specifically a lens and a photodiode, such that the housing focuses the light ray and the cone-shaped tapered area prevents the light rays from being reflected. The housing 10 thus simultaneously serves to electrically contact the circuit boards 15*a*, 15*b*, 15*c* positioned on the housing 10 and to hold the optical components in position. The third conductive element 40 positioned in the wall 11 is not limited to producing the electrical contact between the circuit boards 15*a*, 15*b*, 15*c*, but can assume other functions as well, e.g., furnishing the aperture 45 or the fasteners 46*a*, 46*b*, 46*c*, 46*d*.

In particular, the conductive element 40 in the vicinity of the base body 44 or of the aperture 45 can be designed, at least in sections, as a lattice, one which ideally will be positioned in circumferential fashion in the wall 11, particularly in the transitional area which forms a central section between the first section 10*a* and the second section 10*b*. This lattice, which is not depicted in FIG. 3, provides an advantage in that it can be easily coated with plastic, without the plastic housing 10 losing stability; at the same time, it can serve as an electromagnetic screen or shield for the interior of the housing 10. Here a lattice in the area of the face area 12 or the aperture 45 can form an axial electromagnetic shield, while a lattice in the vicinity of the wall 11 can provide a lateral electromagnetic screen.

The embodiment shown in FIG. 3 is particularly preferred in applications using light barriers or light curtains, since optical components can simultaneously be positioned in the housing 10, while said housing 10 serves to contact the circuit boards 15*a*, 15*b*, 15*c*. These circuit boards 15*a*, 15*b*, 15*c* can thus be positioned in space-saving fashion around the housing 10, and a particularly compact design is permitted. In light curtains this makes it possible, e.g., to house as many transmitters and receivers as possible in a small space.

FIG. 6 shows this kind of arrangement in a partially sectioned perspective view. Applied to the face area 12 of the housing 10 are two holes 43, while a light transmitter is positioned on the outside of the housing 10 behind one of the openings 43 and a light receiver is positioned behind the other hole 43, also on the outside of housing 10. Inside the housing 10, each hole 43 conically widens in the direction of the lens 47, which is positioned on the face area 13 opposite the face area 12. The circuit boards 15*a*, 15*b*, 15*c* are positioned in front of the face area 12 and two lateral walls, at a minimum. Positioned in the housing 10 is the third electrically conductive element 40, of which the sectioned view specifically depicts the base body 44, as well as the initial connector elements 41 positioned on it, which are laterally guided within contact boreholes in the circuit board 15*a*; and the second connector elements 42, which are guided within contact boreholes in the circuit board 15*b*, which rests in front of the face area 12. The electrically conductive connection between the circuit boards 15*a*, 15*b*, 15*c* occurs over the initial connector elements 41 and the second connector elements 42. Also evident is the aperture 45 formed in the third conductive element 40, which aperture 45 is positioned in front of one of the holes 43, either in front of the light transmitter or the light receiver. The optical and electronic equipment required by a light barrier is thus positioned as compactly as possible.

The housing 10 with the integrated conductive elements 20, 30, 40 can be used not only to connect circuit boards positioned at angle to each other, particularly a right angle, but also to electrically contact a circuit using a plug contact or other connecting cable. Thus FIGS. 4 and 5 give a longitudinal section along a sidewall of the housing 10 shaped as a tube. Positioned on the outside of the housing 10 is a circuit board 15*d*.

In the exemplary embodiment shown in FIG. 4 a fourth electrically conductive element 50 is positioned within the sidewall of the housing 10. This conductive element 50 exhibits its initial connector elements 51, which are guided through the sidewall of the housing and which contact the circuit board 15*d*. Positioned on the fourth conductive element 50 is a second connector element 52, which is guided through the face area 12 of the housing and which ends in an intersecting terminal 54, also depicted schematically by FIG. 4 in cross-section. A connecting cable 55 can be inserted into the intersecting terminal 54 and electrically contacted there. The intersecting terminal 54 can be positioned in a housing seal 57, which also functions as a cable grip. As before, the fourth conductive element 50 may be designed as a lattice and function as an electromagnetic shield.

In the exemplary embodiment shown in FIG. 5 the initial connector elements 51 are also guided through the sidewall of the housing 10 in order to contact the circuit board 15*d*. As an alternative to the second connector element 52 of the embodiment shown in FIG. 4, the exemplary embodiment shown in FIG. 5 exhibits two second connector elements 53, which are guided through the face area 12 of the housing 10, specifically through the housing seal 57, and which end in the two pins 56 of a plug contact. With this kind of plug contact the housing 10 can be contacted in a very simple manner.

Depending on the purpose of the application and the desired type of contacting or screening, the electrically conductive elements 20, 30, 40, 50 may take the form of a wire-shaped or track-type element or also—at least in parts—the form of a lattice or a holohedral element, e.g., a holohedral metal foil.

LIST OF REFERENCE NUMERALS

10 housing
10*a* section
10*b* section
11 wall
12 face area
13 face area
14 wire
15*a* circuit board
15*b* circuit board
15*c* circuit board
15*d* circuit board
20 first electrically conductive element
21 first connector element
22 second connector element
30 second electrically conductive element
31 first connector element
32 second connector element
40 third electrically conductive element
41 first connector element
42 second connector element
43 hole
44 base body
45 aperture
46*a* fastener
46*b* fastener
46*c* fastener
46*d* fastener
47 lens
48 photodiode
50 fourth electrically conductive element
51 first connector element
52 second connector element
53 second connector element
54 intersecting terminal
55 connector cable
56 pin
57 housing seal
e longitudinal axis

The invention claimed is:

1. Device for electrically contacting circuit boards that are positioned in basically perpendicular fashion relative to each other, with an insulating housing (10) in the form of an optical tube, wherein at least one electrically conductive element (20, 30, 40, 50) exhibiting at least two connector elements (21, 22, 31, 32, 41, 42, 51, 52, 53) is positioned in a wall (11) of the optical tube such that the connector elements (21, 22, 31, 32, 41, 42, 51, 52, 53) project from the optical tube wall (11) of the housing (10), and wherein an inner area of the optical tube is provided with a light absorbing surface.

2. Device according to claim 1, wherein at least one electrically conductive element (20, 30, 40, 50) is coated with an insulating plastic to form the housing (10).

3. Device according to claim 1, wherein one of the two or more connector elements (22, 32, 42, 52, 53) projects from the housing on a face area (12) of the housing (10) and the other of the two or more connector elements (21, 31, 41, 51, 51) projects from the housing on a jacket side of the housing (10).

4. Device according to claim 1, wherein the connector elements (21, 22, 31, 32, 41, 42, 51, 52, 53) take the form of plug contacts, force-fitting contacts, soldered pins, or elastic elements.

5. Device according to claim 1, wherein the electrically conductive element (20, 30, 40, 50) is formed from at least one punching, preferably an elastic punching.

6. Device according to claim 1, wherein fasteners (46*a*, 46*b*, 46*c*, 46*d*) for securing an optical element, particularly a lens (47), are formed on the electrically conductive element (40), such that said fasteners (46*a*, 46*b*, 46*c*, 46*d*) project from the housing (10).

7. Device according to claim 6, wherein the fasteners (46*a*, 46*b*, 46*c*, 46*d*) take the form of elastic elements.

8. Device according to claim 1, wherein at least one aperture (45) is formed in the electrically conductive element (40), such that said aperture (45) is ideally positioned in one of the face areas (12) of the housing (10).

9. Device according to claim 8, wherein an inner diameter of the housing (10) grows smaller in the direction of the aperture (45).

10. Device according to claim 1, wherein the electrically conductive element (20, 30, 40, 50) takes the form of a lattice or a holohedral element, at least in sections.

11. Device according to claim 1, wherein the electrically conductive element (20, 30, 40, 50) is positioned in circular fashion inside the optical tube wall (11), at least in a central section of the housing (10).

12. Device according to claim 1, wherein the electrically conductive element (20, 30, 40, 50) is designed as an electromagnetic shield.

13. Device according to claim 1, further comprising at least one of a light barrier and a light curtain.

14. Device according to claim 2, wherein one of the two or more connector elements (22, 32, 42, 52, 53) projects from the housing on a face area (12) of the housing (10) and the other of the two or more connector elements (21, 31, 41, 51, 51) projects from the housing on a jacket side of the housing (10).

15. Device according to claim 3, wherein the connector elements (21, 22, 31, 32, 41, 42, 51, 52, 53) take the form of plug contacts, force-fitting contacts, soldered pins, or elastic elements.

16. Device according to claim 5,
wherein
fasteners (46*a*, 46*b*, 46*c*, 46*d*) for securing an optical element, particularly a lens (47), are formed on the electrically conductive element (40), such that said fasteners (46*a*, 46*b*, 46*c*, 46*d*) project from the housing (10).

17. Device according to claim 6,
wherein
the electrically conductive element (20, 30, 40, 50) takes the form of a lattice or a holohedral element, at least in sections.

18. Device according to claim 8,
wherein
the electrically conductive element (20, 30, 40, 50) is positioned in circular fashion inside the optical tube wall (11), at least in a central section of the housing (10).

19. Device according to claim 8,
wherein
the electrically conductive element (20, 30, 40, 50) is designed as an electromagnetic shield.

* * * * *